United States Patent [19]

LeGrady

[11] 4,107,895

[45] Aug. 22, 1978

[54] REINFORCING BAR LOCATING MEANS

[76] Inventor: Carl F. LeGrady, 1024 N. 21st Ave., Phoenix, Ariz. 85009

[21] Appl. No.: 794,833

[22] Filed: May 9, 1977

Related U.S. Application Data

[63] Continuation-in-part of Ser. No. 633,645, Nov. 20, 1975, abandoned.

[51] Int. Cl.[2] ..... E04C 5/18

[52] U.S. Cl. ..... 52/687; 52/423; 52/426; 52/438

[58] Field of Search ..... 52/712, 589, 228, 314, 52/405, 439, 293, 433, 438, 690, 442, 562, 686, 437, 606, 426, 503, 513, 677, 678, 679, 680, 428, 687, 423; 249/91; 24/81 C, 81 CC, 261 D

[56] References Cited

U.S. PATENT DOCUMENTS

| | | | |
|---|---|---|---|
| 1,240,137 | 9/1917 | Hartman | 52/687 |
| 1,673,431 | 6/1928 | Voight | 52/681 |
| 2,089,495 | 8/1937 | Lewis | 52/606 X |
| 2,124,799 | 7/1938 | Specht | 52/442 X |
| 2,684,589 | 7/1954 | Perreton | 52/589 |
| 2,887,869 | 5/1959 | McKay | 52/433 |
| 2,929,238 | 3/1960 | Kaye | 52/690 |
| 3,145,505 | 8/1964 | Cornelius | 52/428 X |
| 3,546,833 | 12/1970 | Perreton | 52/442 X |

FOREIGN PATENT DOCUMENTS

| | | | |
|---|---|---|---|
| 80,979 | 5/1956 | Denmark | 52/410 |
| 745,191 | 2/1933 | France | 52/687 |

*Primary Examiner*—Alfred C. Perham
*Attorney, Agent, or Firm*—Dean, Flickinger & Robertson

[57] ABSTRACT

The disclosure relates to a reinforcing bar locating means adapted for disposition in a mortar layer between courses of concrete blocks; the reinforcing bar locating means made of a single wire and comprising a generally S-shaped intermediate portion provided with a pair of generally oppositely directed anchor portions adapted to be imbedded in mortar between courses of concrete blocks and in position wherein the loop portions of the generally S-shaped portion each being adapted to hold and locate a reinforcing bar member generally centrally in a void area of a concrete block wall.

3 Claims, 5 Drawing Figures

REINFORCING BAR LOCATING MEANS

This application is a continuation-in-part application of my co-pending application, Ser. No. 633,645 filed Nov. 20, 1975 now abandoned, for "Reinforcing Bar Locating Means."

PRIOR ART

The following U.S. patents are believed to be pertinent prior art:

U.S. Pat. No. 3,546,833
U.S. Pat. No. 2,684,589
U.S. Pat. No. 2,887,869
U.S. Pat. No. 2,929,238
U.S. Pat. No. 3,145,505

BACKGROUND OF THE INVENTION

The foregoing prior art patents are representative of the prior art and are relatively complicated devices which are relatively expensive and complicated to manufacture in the terms of automation and especially in wire products where separate parts must be coupled to longitudinal or cross wires during the assembly or automatic welding of the parts together. In the operation of automated wire product machines, it has been relatively complicated to produce parts where separate small loops are welded to reinforcing structure cross wires or where the loops have been welded to individual wires. Such operations require relatively complex machinery and tend to slow the rate of production and consequently compromise the eventual retail cost of the parts.

SUMMARY OF THE INVENTION

The present invention comprises a reinforcing bar locating means composed of a single piece of wire and having a generally S-shaped portion with a pair of generally looped shaped bar receiving portions integral with which are a pair of generally oppositely extending anchor portions adapted to be imbedded in a layer of mortar between concrete blocks so that the aforementioned loop portions are aligned with a void in the block so as to locate reinforcing bars in an efficient manner for the pouring of mortar therearound. The present invention is an economic as well as a practical improvement over the prior art since it involves only a single piece of wire which is formed into a generally S-shaped portion and thereby obviating the necessity of feeding separate parts into a machine and locating them while welding the separate parts onto other wire parts either in the usual concrete block reinforcing wire structures or in the forming of single reinforcing bar locating devices. Accordingly, the concept of the present invention has afforded an improvement in the automation of manufacturing and the economy thereof, particularly as it relates to reinforcing bar locating means adapted to be imbedded in a mortar layer between courses of concrete blocks and to align with a void in the blocks for holding reinforcing bars properly aligned with a void so as to provide an accurate means by which the bars may be held for the pouring of mortar therearound.

In the specific detail of the structure of the invention, a generally S-shaped median portion is in the form of a capital letter S, and thus provided with a pair of loop portions with which integral oppositely extending arms are directed generally away from each other and with which anchor portions are integral and the anchor portions are preferably disposed at an angle to the arm portions.

The aforementioned S-shaped portion or structure, having a normally up and down axis as it may relate to a capital letter S, and the aforementioned arm portions, are disposed at an angle to the up and down axis, and the anchor portions are preferably disposed at an angle to the arm portions, and the anchor portions are disposed in spaced apart relation so as to coincide with the intermediate portions of opposite side walls of concrete blocks so that the anchor portions may be imbedded in mortar between the blocks. The aforementioned loop portions are generally pear-shaped and are adapted to support reinforcing bar therebetween and the spacing at the ends of the loop portions and adjacent the arm portions being such as to prevent the displacement of reinforcing bars of the desired diameter therebetween; the spacing being of a dimension less than the diameter of the desired reinforcing bars to be located therein.

As shown in FIGS. 2 and 3 of the drawings, all of the portions of the reinforcing bar locating means of the invention are disposed on a substantially common plane so as to be located in a mortar layer between superimposed courses of concrete blocks.

The one piece S-shaped structure of the invention, comprising oppositely extending arms and anchor portions, provides s shape which promotes the use of rapidly operable automatic machinery adapted to produce these locating devices in volume and a very reasonable cost.

Accordingly, it is an object of the present invention to provide a reinforcing bar locating means which is very easy to produce in high volume at a minimum cost.

Another object of the invention is to provide an improved reinforcing bar locating means particularly adapted for high volume production and very efficient and accurate structural shape and dimensions of the product.

Another object of the invention is to provide a reinforcing bar locating means which is particularly adapted for production by high speed wire forming machinery which has been developed for the specific purpose.

Further objects and advantages of the invention may be apparent from the following specification, appended claims and accompanying drawings.

DESCRIPTION OF THE PREFERRED EMBODIMENTS

Figure 1:
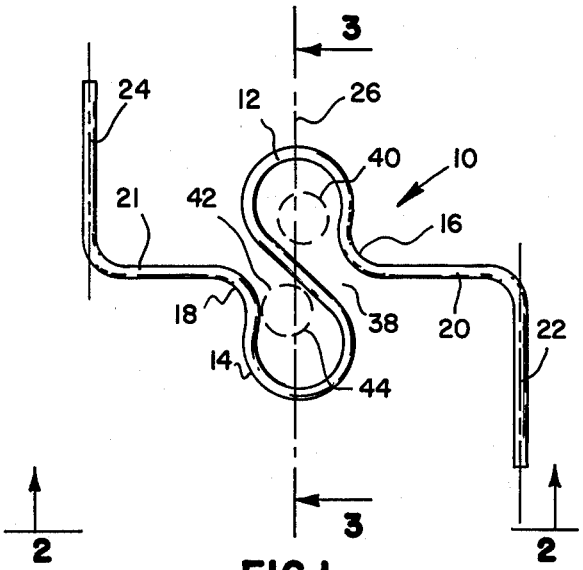
FIG. 1 is a top or plan view of a reinforcing bar locating means of the invention.
Figure 2:
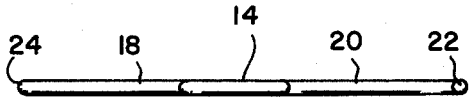
FIG. 2 is an end view taken from the line 2—2 of FIG. 1.
Figure 3:
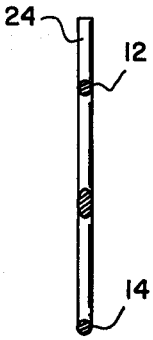
FIG. 3 is a sectional view taken from the line 3—3 of FIG. 1.

As shown in FIGS. 1, 2 and 3, the reinforcing bar locating means of the invention is designated 10 and this means is formed of a single piece of wire having a generally S-shaped intermediate portion comprising a pair of integral reinforcing bar locating loops 12 and 14; the S-shaped structure, of which the loops 12 and 14 are integral, is provided with opposite ends 16 and 18 are integral with these opposite ends 16 and 18 are arms 20 and 21 integral with which are respective anchor portions 22 and 24.

The intermediate S-shaped portion of the reinforcing bar locating means is in the form of a capital letter S, as it may be disposed in correspondence therewith and in such disposition the S-shaped intermediate portion is provided with a generally vertical axis 26 relative to which the arm portions 20 and 21 are angularly disposed and, as shown in FIG. 1, the anchor portions 22 and 24 are integral with the respective arm portions 20 and 21 and are disposed at an angle thereto. These anchor portions 22 and 24 are spaced apart a sufficient distance to be aligned with intermediate areas 28 and 30 of concrete block structures shown in FIG. 4 of the drawings; the intermediate areas being generally intermediate of side walls 32 and 34, having respective openings 36 therein with which the S-shaped structure 10 may be aligned while the anchor portions 22 and 24 may be disposed in mortar between the courses of such concrete blocks, all as shown best in FIGS. 4 and 5 of the drawings.

Most conventional concrete blocks are 8 inches wide and 16 inches long and, as for example, the anchor portions 22 and 24 may be spaced apart a distance ranging between $5\frac{1}{2}$ inches to $7\frac{1}{2}$ inches.

The loop shaped portion 12 is provided with an open space 38 which is narrower than the diameter of a respective reinforcing bar 40 retained therein and likewise, the loop shaped portion 14 is provided with an open space 42; the spacing which is less than the diameter of a respective reinforcing bar 44 retained therein.

Figure 5:
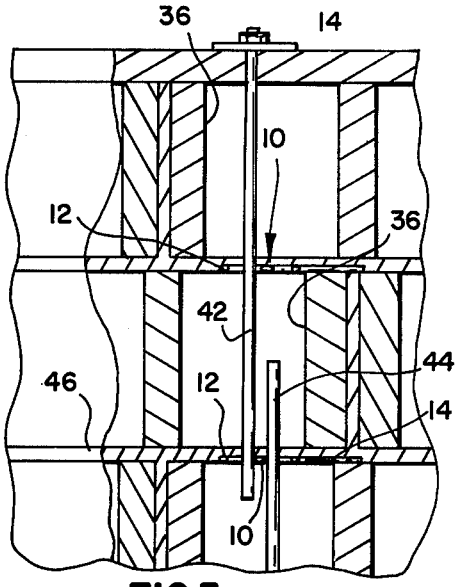
FIG. 5 is a fragmentary sectional view taken from the line 5—5 of FIG. 4.

As shown in FIG. 5 of the drawings, the reinforcing bar locating means of the invention may be located between courses of concrete blocks in mortar layers designated 46 and the reinforcing bar locating means 10 in each course is aligned generally centrally of the respective voids 36 in the respective concrete blocks so as to provide for generally central alignment of the reinforcing bars 42 and 44 in the voids 36 so that they are maintained straight and so that concrete mortar may be poured therearound to fill the voids 36 and to bond the reinforcing bars 42 and 44 accurately therein.

Figure 4:
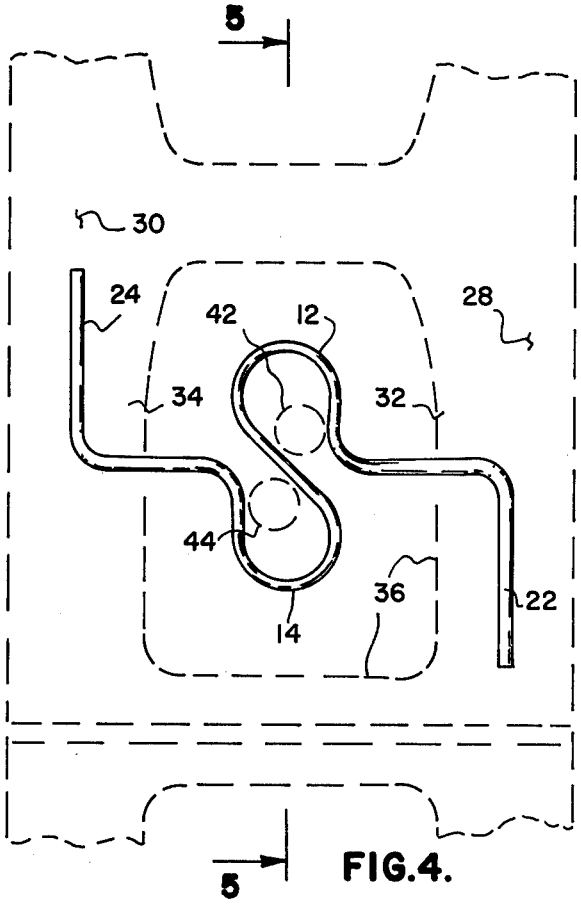
FIG. 4 is a top or plan view of the invention similar to FIG. 1 but showing by broken lines the relationship of concrete blocks to the reinforcing bar locating means of the invention.

It will be understood that the arm portions 20 and 21, shown in FIGS. 1 and 4 of the drawings, may be angularly disposed relative to the up and down axis of the S-shaped structure of the locating means and that the angle may vary from 90° to some other reasonable degree while the angularity of the anchor portions 22 and 24 may vary relative to the arms 20 and 21 as desired without compromising the structure and its geometry which is susceptable to high volume manufacture by automatic machines.

It will be obvious to those skilled in the art that the angular disposition of the arms 20 and 21 and the anchor portions 22 and 24 may vary slightly without departing from the invention and that the shape of the anchor portions 22 and 24 may vary. However, generally straight portions, as shown in FIG. 1, are preferred for the purpose of simplicity and efficiency in anchoring the reinforcing bar locating means in mortar in the median areas 28 and 30 of the opposite walls of the concrete block structures, as shown in FIG. 4 of the drawings.

It will be obvious to those skilled in the art that various modifications may be resorted to without departing from the spirit of the invention.

I claim:

1. In a reinforcing bar locating means; a single piece of wire having an S-shaped portion; said S-shaped portion having a pair of generally loop shaped bar receiving portions; said S-shaped portion having a pair of opposite end portions; arm portions integral with said opposite end portions of said loop shaped portions of said S-shaped portion; said arm portions extending in generally opposite directions relative to each other; said arm portions each having an anchor portion integral therewith; said anchor portions being spaced apart a distance substantially equal to a spacing between median areas of opposite side walls of a concrete block; said locating means being sized for disposition in a mortar layer between courses of concrete blocks; said S-shaped portion being disposed to overly a vertical opening between said side walls of a respective concrete block.

2. In a reinforcing bar locating means; a single piece of wire having an S-shaped portion having a pair of opposite end portions; arm portions integral with said opposite end portions of said S-shaped portion; said arm portions extending in generally opposite directions relative to each other; said arm portions each having an anchor portion integral therewith; said anchor portions being spaced apart a distance substantially equal to spacing between median areas of opposite side walls of a concrete block; said locating means being sized for disposition in a mortar layer between courses of concrete blocks; said S-shaped portion being disposed to overly a vertical opening between said side walls of a respective concrete block; all of said portions being disposed on a substantially common plane relative to each other so as to be located in a mortar layer between concrete blocks.

3. In a reinforcing bar locating means; a single piece of wire having an S-shaped portion formed with a pair of loop-shaped portions and having a pair of opposite end portions; arm portions integral with said opposite end portions of said S-shaped portion; said arm portions extending in generally opposite directions relative to each other, said arm portions each having an anchor portion integral therewith, said anchor portions being spaced apart a distance substantially equal to the spacing between median areas of opposite side walls of a concrete block, said locating means being sized or dispositioned in a mortar layer between courses of concrete blocks, said looped portions being disposed to overlie vertical openings between said side walls of a respective concrete block and presenting open spaces which are less in diameter than the diameters of reinforcing bars to be retained in said looped portions.

* * * * *